United States Patent [19]

Kiniry

[11] Patent Number: 4,848,709

[45] Date of Patent: Jul. 18, 1989

[54] TRASH BAG SUPPORT DEVICE

[76] Inventor: Sam Kiniry, 6718 S. 1300 East, Salt Lake City, Utah 84121

[21] Appl. No.: 200,362

[22] Filed: May 31, 1988

[51] Int. Cl.[4] ..... B65B 67/12

[52] U.S. Cl. ..... 248/101

[58] Field of Search ..... 248/95, 97–101; 220/404

[56] References Cited

U.S. PATENT DOCUMENTS

| | | | |
|---|---|---|---|
| 1,822,747 | 9/1931 | Richardson | 248/101 |
| 1,995,830 | 3/1935 | Barnsby | 248/99 X |
| 2,788,947 | 4/1957 | Kleiser | 248/101 X |
| 2,789,781 | 4/1957 | Miller | 248/101 X |
| 3,388,882 | 6/1968 | Burroughs et al. | 248/97 |
| 4,318,501 | 3/1982 | Garber | 248/225.31 X |
| 4,319,726 | 3/1982 | Andersson | 248/97 |
| 4,707,889 | 11/1987 | Sato | 248/101 X |

FOREIGN PATENT DOCUMENTS

| | | | |
|---|---|---|---|
| 1101819 | 5/1981 | Canada | 248/99 |

*Primary Examiner*—Alvin C. Chin-Shue

*Attorney, Agent, or Firm*—Thorpe, North & Western

[57] ABSTRACT

A support and retention device for attachment to a top perimeter of a plastic trash bag at its opening and useful for positioning the bag at the bumper of a recreational vehicle or in similar applications. The device comprises a pair of U-shaped support members which are rotationally attached at distal ends thereof to form a continuous perimeter configuration which is capable of being closed to a U-shaped configuration. A pair of elongated gripping members corresponding in configuration to horizontal elements of the support members are movably coupled together by coupling structure which enables selection of (i) an open position wherein the gripping member is slightly displaced away from the support member to permit insertion of a portion of the top perimeter of a trash bag therebetween, and (ii) a closed position wherein the bag top perimeter is caught between the gripping member and support member in fixed position. Mounting means are provided for attachment of the support device to a bumper, door, or other upright support surface.

15 Claims, 3 Drawing Sheets

TRASH BAG SUPPORT DEVICE

BACKGROUND OF THE INVENTION

1. Field of Invention

The present invention relates to devices which support plastic trash bags in upright orientation for use as a trash receptacle. More particularly, the present invention relates to such a device which can be readily attached to the bumper of a motor home, or to other support structure such as a cabinet door or ground mount.

2. Prior Art

The low cost and convenience of using plastic trash bags has resulted in applications in virtually every field of human activity. Typically, such trash bags are supported within a trash receptacle which maintains the bag in upright orientation with the top perimeter of the bag open to receive trash. Other types of support devices merely suspend the bag from a perimeter support such as is shown in U.S. Pat. No. 4,319,726 by Andersson. This patent discloses a weed removal iron or spear which includes a circular support ring at the top of the iron for attachment of the trash bag. A similar vertical support structure is shown in U.S. Pat. No. 3,679,160 by Ballenger. This structure provides an upright tubular member which can be inserted in the ground and which has an upper frame or tubular ring which supports the trash bag. A cover is mounted on the upper frame and operates to grip the top perimeter of the trash bag in an open configuration for receiving trash.

Both of these structures illustrate the common configuration of a column-type support device for plastic trash bags. This is characterized by a top support ring which maintains the trash bag in an open configuration, with the body of the bag suspended below the ring for retaining trash therein. Generally such support structure is capable of folding or collapsing to a small size to facilitate storage and easy transport between places of use. The support mechanism for holding the assembly in upright orientation comprises either a ground spear or a base frame which allows the assembly to stand on ground or concrete surfaces.

U.S. Pat. No. 3,991,961 illustrates a variation of this conventional type of trash bag support wherein the mount is adapted for use on a ledge or some other lateral support location. U.S. Pat. No. 4,318,501 illustrates another form of bumper attachment for providing upright support; however, this reference relates to the mounting of bicycle carrier racks onto vehicles.

A common problem associated with general support structure for trash bags is the fixed, open position of the top bag, permitting access to insects and scavenging animals. In addtion, the open configuration permits odors to permeate the area. These problems are particuarly acute where the trash bag is intended for outdoor use such as in picnic grounds and campsites. In these applications, food is usually a component of the trash content and invites flies, insects and small animals access to the debris because of the fixed open configuration.

Although many trash bags now provide tie strings and other closure mechanisms, these are generally intended for use after the bag is filled and ready for deposit in a larger trash receptacle or for trash pickup. Users find such drawstrings very inconvenient to repetitively open and close in order to deposit trash in the trash bag. U.S. Pat. No. 4,537,377 of Shewchuk illustrates one attempt to provide a closing mechanism for handcarried bags. This device comprises front and rear frame members having an inverted U shape which are interconnected by a plastic hinge to allow the frame members to be positioned in an opened or closed configuration. The device requires the bag to have handles which can attach to upright support arms on each respective frame. This device, however, requires a specially designed bag in order to properly fit within the frame and to ensure closure of the bag upon closing the frame members together. A general trash bag would not be suitable for use with such a specialized bag holder.

What is needed, therefore, is a trash bag support device capable of supporting and retaining any typical plastic bag in a securely mounted configuration and with structure which enables easy opening and closing of the top perimeter of the trash bag with a substantially complete seal to retain odor and limit access to insects and animals.

OBJECTS AND SUMMARY OF THE INVENTION

It is an object of the present invention to provide a plastic trash bag support device which can accept virtually any style of plastic trash bag in a configuration which is easily opened or closed.

It is a further object of the present invention to provide such a trash bag which is adapted for attachment to the bumper of a motor home, trailer or other recreational vehicle.

A still further object of this invention is to provide such a device which can be ground mounted or attached to other support structures such as a cupboard door.

These and other objects are realized in a support and retention device for attachment to a top perimeter of a plastic trash bag at its opening and which includes a pair of U-shaped support members, each having a horizontal element and two legs projecting therefrom in a common plane. The legs of one U-shaped member are rotationally attached at distal ends to the distal ends of the corresponding legs of the other U-shaped member in a manner such that the pair of U-shaped members may be rotationally aligned in a closed U-shaped configuration or opened to a closed perimeter configuration wherein the trash bag opening is fully exposed. A pair of hinge means are attached between respective distal ends of the U-shaped members to provide the required rotational attachment. The device further includes a pair of elongated gripping members corresponding in configuration to the horizontal elements of the support members. Means are provided for movably coupling each gripping member to a corresponding U-shaped support member. This coupling means includes structure to enable selection of (i) an open position wherein the gripping member is slightly displaced away from the support member to permit insertion of a portion of the top perimeter of the plastic bag, and (ii) a closed position wherein the top perimeter of the bag is caught between the gripping member and the support member in fixed position. This enables retention of the trash bag in an attached and suspended configuration in which the opening of the bag is substantially closed when the support members are rotated to the closed U-shaped configuration and open when rotated to the closed perimeter configuration. Mounting means are provided at one of the support members for enabling attachment of the device to elevated support structure such as an RV bumper, cupboard door, ground mount, tree or other upright column. This inventive structure enables utilization of virtually any plastic trash bag corresponding in size to the total perimeter of the combined U-shaped support members.

Other objects and features of the present invention will be aparent to those skilled in the art in view of the following detailed description, taken in combination with the accompanying drawings.

DETAILED DESCRIPTION OF THE INVENTION

Figure 1:
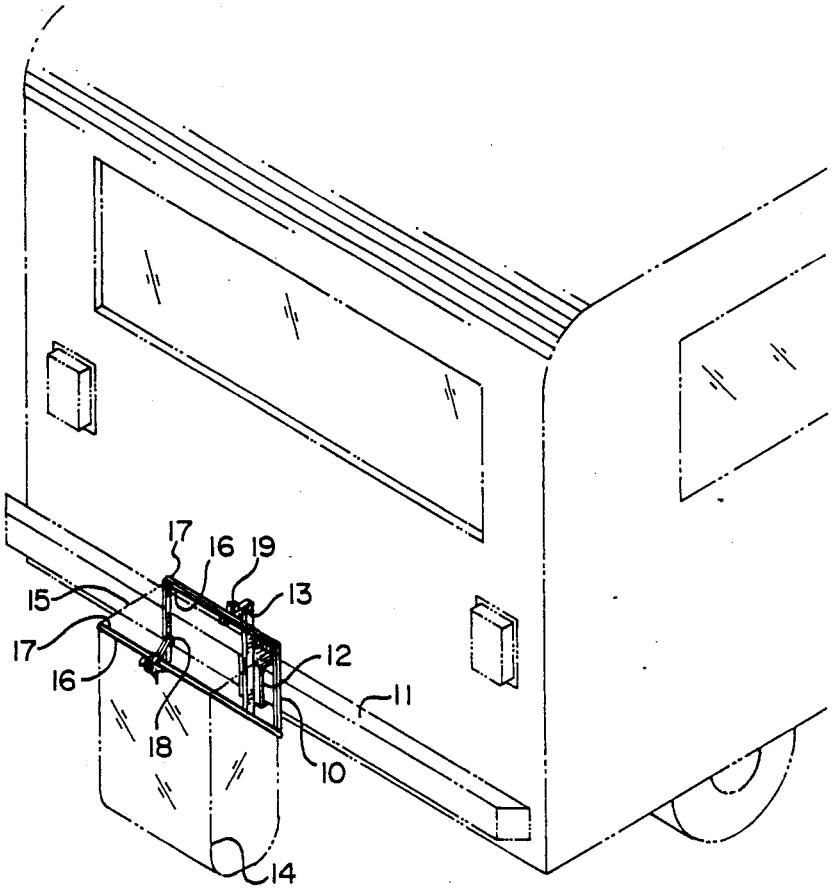
FIG. 1 illustrates the present bag support device attached to a bumper of a recreational vehicle and with a plastic bag illustrated in phantom line.

Referring now to the drawings:

FIG. 1 shows a trash bag support device 10 attached to the bumper 11 of a recreational vehicle by means of a brace 12. This brace includes an upright stem or column 13 which is coupled to the support device 10 and is mounted at brace 12 such that the height of the device 10 can be adjusted by elevating or lowering the column 13 at the brace. A trash bag 14 may be attached to the support device at its top perimeter 15. This top perimeter 15 represents the top opening of the plastic bag 14 and is captured between horizontal support members 16 and gripping members 17. This structure is shown in greater detail in FIG. 2. A latch 18 is provided to secure the device 10 in a closed configuration (not shown) wherein the latch head is retained at an opposite side of a latch catch 19. The mounted trash bag 14 can be quickly accessed by releasing the latch 18 and permitting the top perimeter 15 to extend to an open configuration as shown in FIG. 1. The bag can be quickly closed by pushing the latch 18 toward its engaged position at catch 19.

Figure 2:
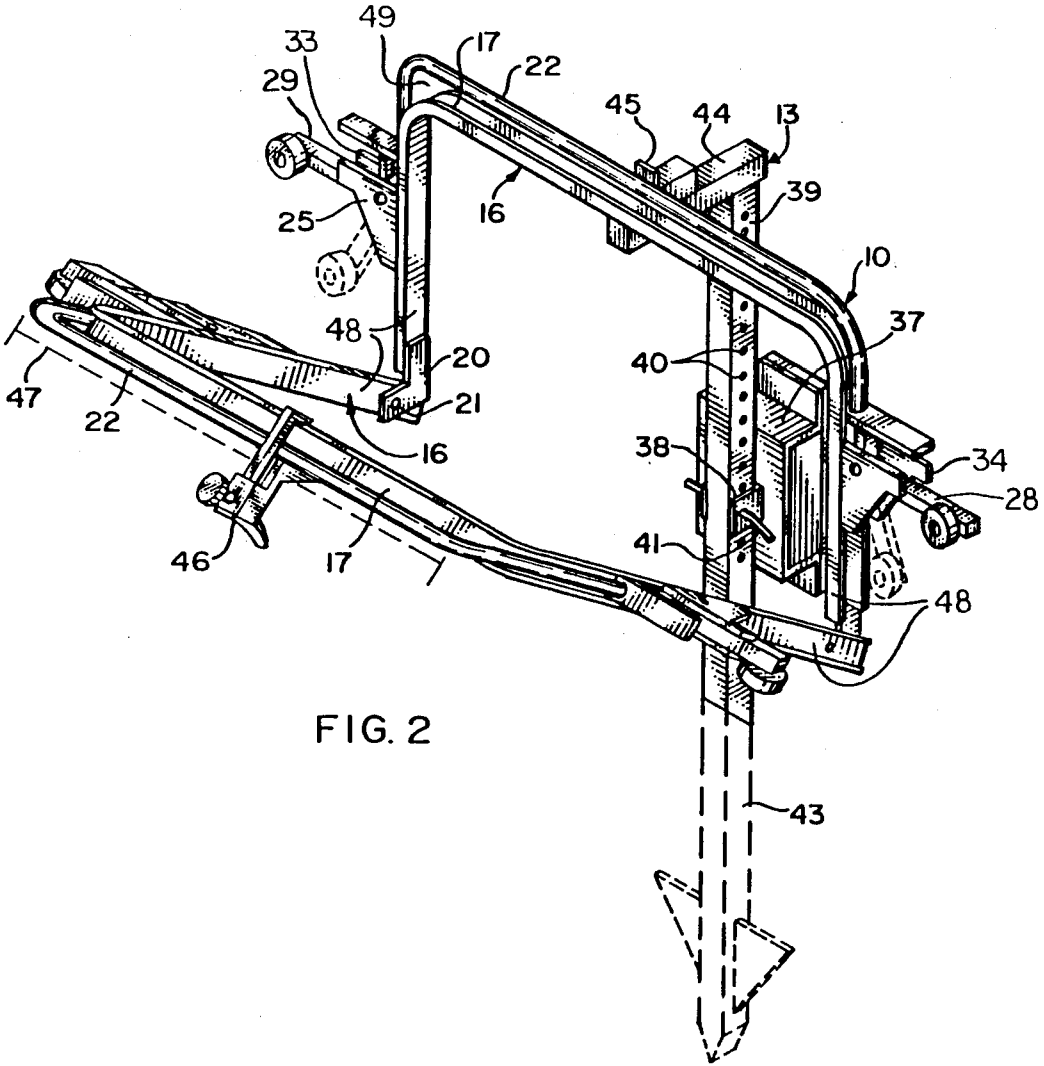
FIG. 2 shows the detailed construction of a preferred embodiment of the present device illustrated in an open configuration.

Referring now to FIG. 2, a more detailed explanation of this support and retention device 10 is provided. It includes a pair of U-shaped support members 16, each of which includes a horizontal element 17 and two legs 48 projecting from the horizontal element 17 in a common plane with the respective U-shaped member. The horizontal member 17 is so named because of its typical horizontal orientation with respect to the elevating support structure which holds the device above ground level. It will be apparent that other orientations could be adopted rather than the suggested horizontal orientation. It is not intended by referring to this element as "horizontal" that its use should be limited to horizontal applications. This term is merely adopted because of simplicity in description.

The two U-shaped support members 16 are rotationally attached at distal ends of corresponding legs in a manner such that the pair of U-shaped members may be rotationally aligned in a closed U-shaped configuration (not shown) or in the opened configuration shown in FIGS. 1 and 2 wherein the closed U shape (similar to FIGS. 4 and 5) is converted to a closed perimeter configuration as illustrated in FIGS. 1 and 2. Reference to the term "closed perimeter configuration" is adopted because of its descriptive reference to a rectangular opening bounded by the continuous perimeter of the rotationally coupled support members 16.

The means for rotational attachment between distal ends of the U-shaped member comprises a hinge 20 attached at each side of the device where this hinge constitutes an L-shaped configuration wherein the short leg of the L has a rivet or bolt 21 for rotatable attachment of one of the support members. This configuration of hinge permits both support members to be closed against each other in side by side relationship as is more clearly shown in FIG. 5 for a similar embodiment. It will be apparent to those skilled in the art that other forms of hinge means can be applied to incorporate the collapsing structure of the respective U members in accordance with the present disclosure.

Whereas the support function of this device is provided by the respective U-shaped members, the retention of the trash bag at the U-shaped members is accomplished by use of a pair of gripping members 22 which correspond in configuration to the horizontal element 17 of the U-shaped member. In the preferred emobodiment shown in FIG. 2, the horizontal support member has an exterior channel 24 (see FIG. 3) into which the gripping member 22 may be seated.

Adjustment means 25 are provided for movably coupling each gripping member to its corresponding U-shaped support member in a manner such that the gripping member can be displaced away from the U-shaped support member, or nested within the channel to provide gripping action at the trash bag perimeter. Specifically, this adjustable coupling means 25 includes a displacement foot 26 which may be rotated against a contact plate 27 coupled at a base end of the gripping member 22 (see FIG. 3). By rotating lever arm 28 downward, the end of the diplacement foot 26 urges the contact plate 27 upward, raising the gripping member out of its nested position with respect to the support member 17. This raised position is shown in FIG. 2, which illustrates a gap 49. This structure enables selection of (i) an open position wherein the gripping member is slightly displaced away from the support member to permit insertion of a portion of the top perimeter of the trash bag (FIG. 2), and (ii) a closed position wherein the bag top perimeter is caught between the gripping member and support channel in a fixed postion, thereby retaining the bag in an attached and suspended configuration. Based on this relationship, the opening of such a supported trash bag is substantially closed when the support members are rotated to the closed U-shaped configuration (represented by the alternative embodiment of FIG. 5) and open when rotated to the closed perimeter configuration (represented by FIG. 2). When lever 29 is displaced upward, the gripping member 22 is returned to its gripping and seated postion within the support member by action of spring biasing means 30 positioned on a support shaft 31 and retaining bolt 32. Protective cover plates 33 and 34 are provided to prevent fingers from being pinched by action of the levers 28 and 29.

The device includes the previously mentioned mounting means 13 to enable attachment of the device to a bumper, cabinet door or ground mount. The structure of this mounting means will depend upon the specific point of attachment and nature of the support structure. With respect to the example provided in FIGS. 1 and 2, attachment of the device is applied with respect to a bumper. In this case, the mounting means consists of a clamp 37 configured to fit around the particular bumper shape. This clamp includes ears 38 which project from the clamp and orientation suitable for mounting around an upright support column 39. This support column may comprise a bar, tube or other rigid structure and may include a series of adjustment holes 40 which are adapted for receiving a mounting pin 41, thereby allowing the user to select the appropriate height of the device and support column with respect to the bumper or other location of attachment. Alternatively, this support column could be configured as a bar including means 43 (shown in phantom line) attached at the base of the column for insertion into the ground, thereby adapting the device for gound use apart from a vehicle or lateral mounting structure.

A mounting neck 44 is coupled to the top of the support column 39 at one end and to the support member 16 at an opposing end. This neck is constructed of rigid material similar to the support column and further includes a catch 45 for engaging a locking means 46 operable to maintain the respective support members 16 in closed U-shaped configuration with the trash bag perimeter substantially sealed. The interlocking relationship between the catch and locking means can be viewed in FIG. 5, with respect to items 50 and 51 representing the locking means and catch respectively. It will be apparent that other forms of locking devices are contemplated within the subject disclosure.

Figure 3:
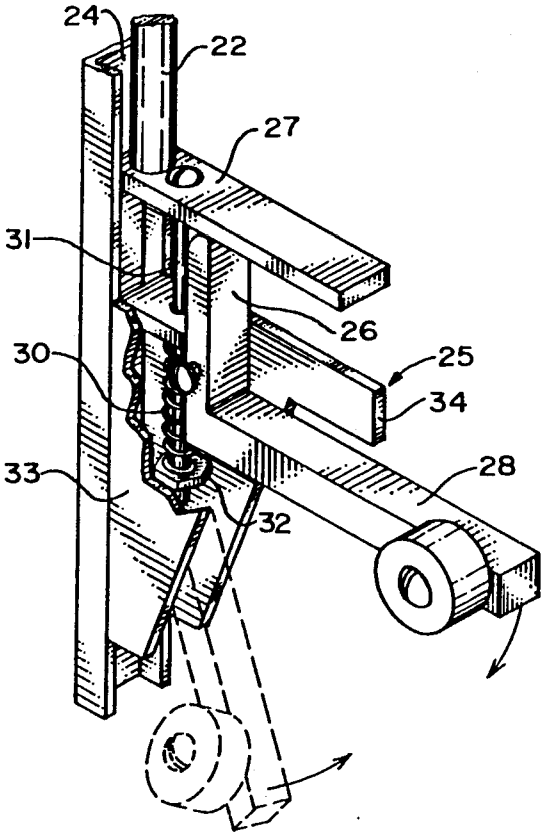
FIG. 3 is a sectional view of a portion of the gripping member used to lock the trash bag in position at its top perimeter.

The accompanying figures represent two basic types of application of the present device. FIGS. 1-3 relate to larger trash bag application such as are typical with campsites. In this embodiment, the trash bag is secured across the horizontal element 17 and partially down the legs 18 to develop a more complete seal when the device is in a closed, locked position. In this case, the legs 18 are attached at ends of the horizontal element and provide a support span 47 which approximately equals the distance between the projecting legs 48 on each support member. As shown in FIG. 2, the gripping member may be configured in corresponding U-shape with the support member and may include a corresponding horizontal element and shorter projecting legs. Typically, these components would be dimensioned to enable the gripping U-shaped member to be capable of being positioned in gripping contact with the corresponding portion of the U-shaped support member. Ideally, the U-shaped gripping member is dimensioned slightly larger than the support member such that the interior perimenter of the U shape of the gripping member approximately corresponds in size and configuration to an exterior perimeter of the U shape of the support member. This configuration maximizes the gripping contact which arises when the gripping member nests within the support member. This is accomplished when the gripping member 22 nests within the referenced channel 24 of the support member. It will also be apparent to those skilled in the art that the referenced gripping member 22 could be configured as a straight bar of approximately equal size and dimension to the horizontal element 17 of th support member. In this instance, the coupling mechanism 25 would be modified or replaced to structurally relate to the coupling member described with respect to FIGS. 4 and 5.

Generally speaking, the coupling means 25 associated with the former U-shaped gripping member will include a lever support base represented by the opposing plates 33 and 34 and operable to support operation of a lever mechanism such as item 28. This lever support base may be attached to either the gripping member or the support member, but would be operable to displace the gripping member by way of some contacting face such as item 27 to open a gap for insertion of the trash bag as previously disclosed. The illustrated attachment of this coupling means at the leg structure set forth in FIGS. 2 and 3 represents the preferred embodiment, with the contacting face 27 in juxtaposed position with respect to the lever support base 33 and 34.

Figure 4:
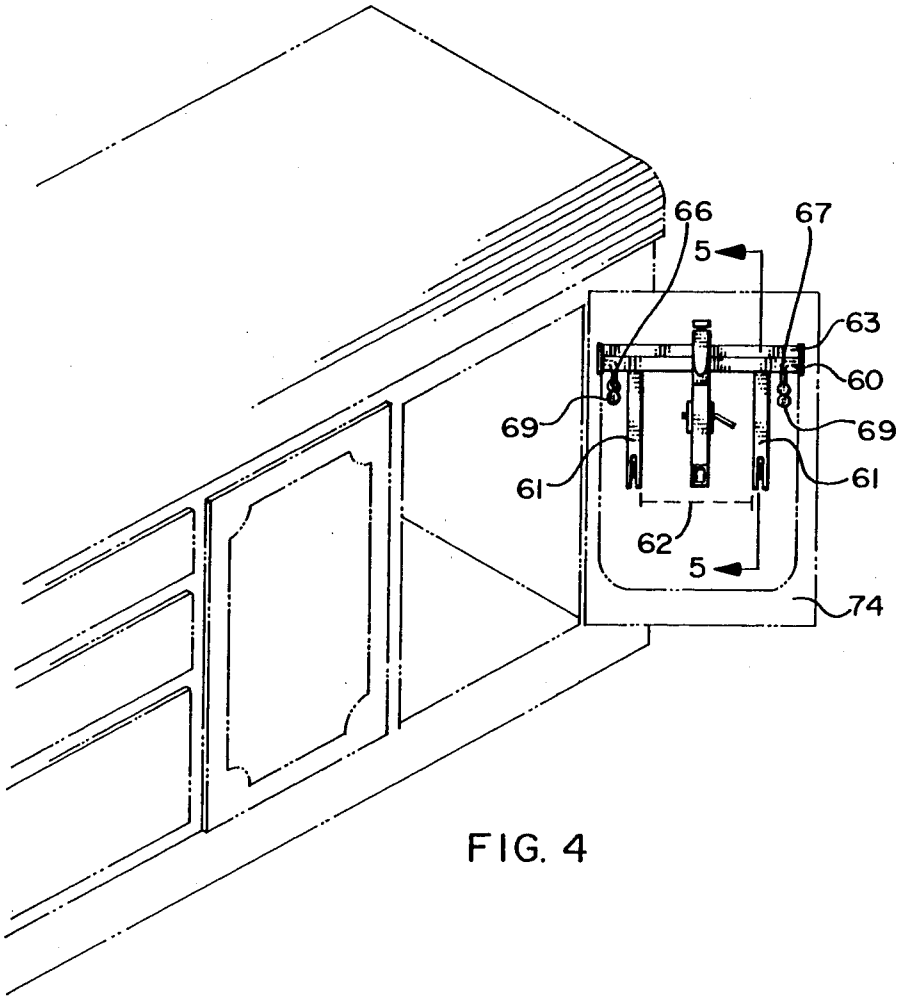
FIG. 4 shows another embodiment of the present invention mounted to a cabinet door in closed configuration.

FIG. 4 discloses an alternate embodiment which is smaller in size and is adapted for attachment to a cupboard door or similar type confining space. This embodiment also incorporates the U-shaped structure provided by horizontal elements 60 which are constructed from substantially straight tubular bar material and having attached legs 61. These legs are attached inward from ends of the bar 60 such that terminal sections of the horizontal elements 60 extend beyond the U-shaped member and provide a support span exceeding the distance 62 between the attached legs 61. The gripping members 63 also comprise a straight bar of approximately equal size and dimension with each horizontal attached element 60. The respective gripping members 63 are coupled to the horizontal elements 60 by a pair of interlocking arms 65 which are attached between separated positions 66 and 67 along the support member and gripping member. These interlocking arms 65 are slidably disposed within the support and gripping members to permit displacement therebetween for development of a gap comparable to item 49 in FIG. 2. Spring biasing means 68 are disposed along at least one of the interlocking arms for biasing the gripping member 63 in abutting contact with the support member 60 to form the referenced closed position. Control levers 69 are coupled to the respective interlocking arms 65 and provide leverage to displace the gripping member away from the support member as discussed.

Figure 5:
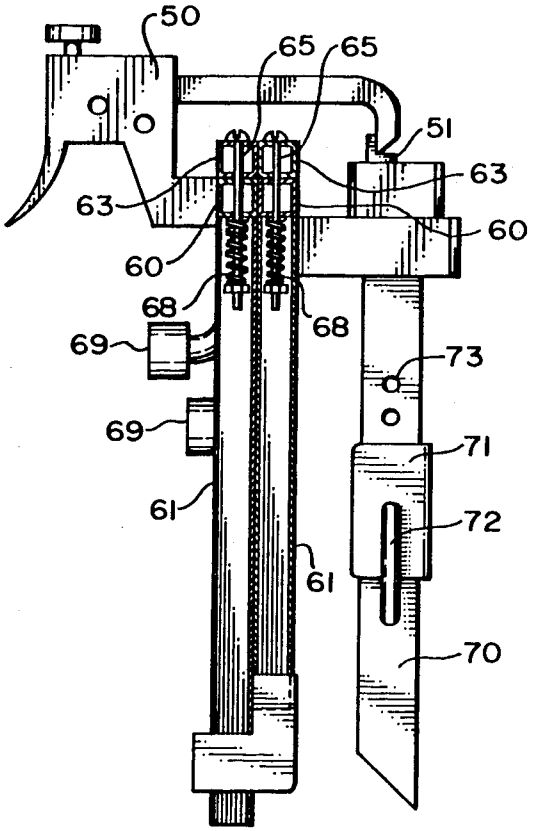
FIG. 5 shows a cross-sectional view of the device illustrated in FIG. 4, taken along the lines 5—5.

Here again, a support column 70 is provided and includes a clamp 71 or other means for attachment to the cupboard door by screws, adhesives, etc. A locking pin 72 and locking eyelets 73 are provided to permit vertical adjustment of the device with respect to the mounting surface 74. The locking means 50 and 51 cooperate in the manner previously described with respect to locking means 46 and 45 to retain the closed position as illustrated in FIGS. 4 and 5.

It is intended that the respective embodiments disclosed herein are to be exemplary, and are not to be construed as limiting, except in accordance with the following claims.

I claim:

1. A support and retention device for attachment to a top perimeter of a plastic trash bag at its opening, said device comprising:

a pair of U-shaped support members, each having a horizontal element and two legs projecting therefrom in a common plane, the legs of one U-shaped member being rotationally attached at distal ends to distal ends of corresponding legs of the other U-shaped member in a manner such that the pair of U-shaped members may be rotationally aligned in a closed U-shaped configuration or opened to a closed perimeter configuration;

a pair of hinge means attached between the respective distal ends of the U-shaped members to provide the stated rotational attachment;

a pair of elongated gripping members corresponding in configuration to the horizontal elements of the support members;

means for movably coupling each gripping member to slide relative to a corresponding U-shaped support member, said coupling means including at least one pivoted lever means separate from said gripping member and operable to slide said gripping member to (i) an open position wherein the gripping member is slightly displaced away from the support member to permit insertion of a portion of the top perimeter of the bag therebetween and (ii) a closed position wherein the bag top perimeter is caught between the gripping member and support member in fixed position, thereby retaining the bag in an attached and suspended configuration in which the opening of the bag is substantially closed when the support members are rotated to the closed U-shaped configuration and open when rotated to the closed perimeter configuration; and mounting means coupled to one of the support members for enabling attachment of the device to elevated support members.

2. A device as defined in claim 1, wherein the horizontal element of the U-shaped member comprises a substantially straight bar, said legs being attached inward from ends of the bar such that terminal sections of the horizontal element extend beyond the U-shaped member and support and grip the perimeter of the bag with a support span exceeding the distance between the attached legs, said gripping member comprising a straight bar of approximately equal size and dimension to the horizontal element.

3. A device as defined in claim 2, wherein the coupling means comprises a pair of interlocking arms, each arm being attached at each of its ends between separated positions along the support member and gripping member, said coupling means further including spring biasing means disposed along at least one of the interlocking arms for biasing the gripping member in abutting contact with the support member to form the closed position, and said lever means operable between the support member and gripping member to displace the gripping member away from the support member for development of the open position.

4. A device as defined in claim 1, wherein the projection legs of the U-shaped member are attached at the ends of the horizontal element to provide a support span approximately equaling the distance between the attached legs, said gripping member comprising a straight bar of approximately equal size and dimension to the horizontal element.

5. A device as defined in claim 4, wherein the gripping member is configured in the corresponding U shape of the support member and including a horizontal element and shorter projecting legs, each dimensioned to enable the gripping U-shaped member to be capable of being positioned in gripping contact with a corresponding portion of the U-shaped support member.

6. A device as defined in claim 5, wherein the U-shaped gripping member is dimensioned slightly larger than the support member such that an interior perimeter of the U shape of the gripping member approximately corresponds in size and configuration to an exterior perimeter of the U shape of the support member to enable the support member to nest within the gripping mmeber in gripping contact.

7. A device as defined in claim 1 wherein said lever means comprises a lever support base and an extendable lever attached to the support member, and said coupling means further comprises a lever contacting face coupled to the gripping member and in proximate, juxtaposed position with the lever support base, said lever being operable to displace the contacting face and gripping member into the open position to enable insertion of the trash bag perimeter.

8. A device as defined in claim 6, wherein said lever means is attached with respect to leg structure of the gripping and support members and comprises a lever support base and an extendable lever attached to the support member, and a lever contacting face coupled to the gripping member and in proximate, juxtaposed position with the lever support base, said lever being operable to displace the contacting face and gripping member into the open position to enable insertion of the trash bag perimeter.

9. A device as defined in claim 8, said coupling means further including spring biasing means operable with respect to the gripping member for biasing the gripping member in abutting contact with the support member to form the closed position, and for resisting displacing action of the lever.

10. A device as defined in claim 1, wherein the mounting means comprises a bracket rigidly attached to the support member with means for attachment to a flat, elevated surface such as a door, wall or cupboard face.

11. A device as defined in claim 1, wherein the elevated support structure comprises an upright support column and the mounting means comprises rigid attachment structure attached between the support member and an upper section of the support column.

12. A device as defined in claim 11, wherein the support column comprises a bar including means attached at a base end of the column for insertion into the ground.

13. A device as defined in claim 11, wherein the column includes a bracket mounted at the base end of the column, said bracket being configured for removable attachment to a bumper of a vehicle.

14. A device as defined in claim 13, wherein the column further includes means for adjusting the relative height of attachment of the column with respect to the bumper.

15. A device as defined in claim 1, further comprising locking means attached to the support members for maintaining the respective support members in closed U-shaped configuration with the trash bag closed.

* * * * *